US006961076B2

(12) United States Patent
Wagner et al.

(10) Patent No.: US 6,961,076 B2
(45) Date of Patent: Nov. 1, 2005

(54) REACTIVE DYE PRINTING PROCESS

(76) Inventors: Barbara Wagner, 1287 Old Colony Rd., Mt. Pleasant, SC (US) 29464; Ming Xu, 2808 Gaston Gate, Mt. Pleasant, SC (US) 29464

( * ) Notice: Subject to any disclaimer, the term of this patent is extended or adjusted under 35 U.S.C. 154(b) by 120 days.

(21) Appl. No.: 10/853,331

(22) Filed: May 25, 2004

(65) Prior Publication Data

US 2004/0219296 A1 Nov. 4, 2004

Related U.S. Application Data

(63) Continuation of application No. 10/068,828, filed on Feb. 6, 2002, now Pat. No. 6,840,614, which is a continuation of application No. 09/322,737, filed on May 28, 1999, now Pat. No. 6,348,939.

(51) Int. Cl.[7] ..... B41J 2/325
(52) U.S. Cl. ..... 347/213
(58) Field of Search ..... 347/213, 217; 428/195; 503/201; 156/230; 430/201

(56) References Cited

U.S. PATENT DOCUMENTS 5,643,709 A * 7/1997 Kamio et al. ..... 430/201
5,645,888 A 7/1997 Titterington
6,040,269 A * 3/2000 Imoto et al. ..... 428/195.1
6,103,041 A * 8/2000 Wagner et al. ..... 156/230

FOREIGN PATENT DOCUMENTS

| | | |
|---|---|---|
| EP | 87303687.5 | 11/1987 |
| EP | 93309425.2 | 6/1994 |
| EP | 94103892.9 | 9/1994 |
| EP | 95115241.2 | 4/1996 |
| GB | 2105735 A | 3/1983 |
| WO | PCT/US99/09387 | 11/1999 |

* cited by examiner

*Primary Examiner*—K. Feggins
(74) *Attorney, Agent, or Firm*—B. Craig Killough

(57) ABSTRACT

A formulation and method of printing an ink or meltable ink layer having reactive dyes or mixtures of reactive dyes and disperse dyes as colorants. The ink or ink melt layer also includes an alkaline substance, a binder, and optionally, a heat-activated printing additive. Permanently bonded color images are provided by the reaction between the reactive dye and the final substrate, which may be any cellulosic, protein, or polyamide fiber material, or mixtures with polyester. Reaction occurs upon heat activation of the printed ink image.

6 Claims, 5 Drawing Sheets

REACTIVE DYE PRINTING PROCESS

This application is a continuation of application Ser. No. 10/068,828, filed Feb. 6, 2002 now U.S. Pat. No. 6,840,614, which is a continuation of application Ser. No. 09/322,737 filed May 28, 1999 now U.S. Pat. No. 6,348,939.

FIELD OF THE INVENTION

This invention relates to printing generally, and more specifically, to a reactive dye which may be thermally printed from a substrate, and a method of printing the reactive dye.

BACKGROUND OF THE INVENTION

Words and designs are frequently printed onto clothing and other textile materials, as well as other objects. Common means of applying such designs to objects include the use of silk screens, and mechanically bonded thermal transfers. The silk screen process is well known in the art, and an example of a mechanical thermal bonding process to textile materials is described in Hare, U.S. Pat. No. 4,224,358.

The use of digital computer technology allows a virtually instantaneous printing of images. For example, video cameras or scanning may be used to capture an image to a computer. The image may then be printed by a computer driven printer, including thermal, ink jet, and laser printers. Computer driven printers are readily available which will print in multiple colors.

Heat activated, or sublimation, transfer dye solids change to a gas at about 400° F., and have a high affinity for polyester at the activation temperature. Once the gassification bonding takes place, the ink is permanently printed and highly resistant to change or fading caused by laundry products. While sublimation dyes yield excellent results when a polyester substrate is used, these dyes have a limited affinity for other materials, such as natural fabrics like cotton and wool. Accordingly, images produced by heat activated inks comprising sublimation dyes which are transferred onto textile materials having a cotton component do not yield the high quality images experienced when images formed by such inks are printed onto a polyester substrate. Images which are printed using sublimation dyes applied by heat and pressure onto substrates of cotton or cotton and polyester blends yield relatively poor results.

The natural tendency of the cotton fiber to absorb inks causes the image to lose its resolution and become distorted. Liquid inks other than sublimation inks wick, or are absorbed by cotton or other absorbent substrates, resulting in printed designs of inferior visual quality, since the printed colors are not properly registered on the substrate. To improve the quality of images transferred onto substrates having a cotton component or other absorbent component, substrates are surface coated with materials such as the coatings described in DeVries, et. al., U.S. Pat. No. 4,021,591. Application of polymer surface coating materials to the substrate allows the surface coating material to bond the ink layer to the substrate, reducing the absorbency of the ink by the cotton and improving the image quality.

Gross coverage of the substrate with the surface coating material does not match the coating with the image to be printed upon it. The surface coating material is applied to the substrate over the general area to which the image layer formed by the inks is to be applied, such as by spraying the material, or applying the material with heat and pressure from manufactured transfer sheets, which are usually rectangular in shape. To achieve full coverage of the surface coating, the area coated with the surface coating material is larger than the area covered by the ink layer. The surface coating extends from the margins of the image after the image is applied to the substrate, which can be seen with the naked eye. The excess surface coating reduces the aesthetic quality of the printed image on the substrate. Further, the surface coating tends to turn yellow with age, which is undesirable on white and other light colored substrates. Yellowing is accelerated with laundering and other exposure to heat, chemicals, or sunlight. A method described in Hale, et. al., U.S. Pat. No. 5,575,877, involves printing the polymer surface coating material to eliminate the margins experienced when aerosol sprays or similar methods are used for gross application of the polymeric coating material.

A process of thermal transfers wherein the ink mechanically bonds to the substrate is described in Hare, U.S. Pat. No. 4,773,953. The resulting mechanical image, as transferred, is a surface bonded image with a raised, plastic like feel to the touch. Thermal transfer paper can transfer an image to a final substrate such as cotton, however, this method has several limitations. First, the entire sheet is transferred, not just the image. Second, such papers are heavily coated with polymeric material to bind the image onto the textile. This material makes the transfer area very stiff and has poor dimensional stability when stretched. Finally, the laundering durability is not improved to acceptable levels. The thermal transfer paper technology (cited Hare patent) only creates a temporary bond between the transfer materials and the final substrate. This bond is not durable to washing.

The use of reactive dyes for printing on cotton and other natural fibers is well known in the art. For example, Gutjahr, et. al. in "Textile Printing", Second Edition, pp. 157–163 and Akerblom, et. al., U.S. Pat. No. 5,196,030 describe methods for the use of reactive dyes in print pastes for direct printing onto cellulosic fabrics using traditional printing techniques, such as silk-screen printing. Mehl, et. al, U.S. Pat. No. 4,664,670 describes the use of a transfer sheet impregnated with a nitrogen-containing compound that is printed by offset, gravure, or other traditional techniques using a sparingly soluble, non-subliming dye and a binder. The image thus produced is then transferred to cellulose or polyamide fibers. Koller, et. al., U.S. Pat. No. 4,097,229 describes the use of anthraquinone-type, sublimable, fiber-reactive disperse dyes that can be applied to a carrier sheet by spraying, coating, or printing, by such methods as flexogravure, silk-screen, or relief printing, and subsequently heat transferred to cellulose or polyamide fabrics. None of these processes are printed digitally and require pre- and after-treatments.

Digital printing processes using reactive dyes are known. For example, Yamamoto, et. al, U.S. Pat. No. 5,250,121 describes the use of a monochlorotriazine and/or vinyl sulfone reactive dye in an aqueous ink jet ink for printing directly onto pretreated cellulosic fabric. Von der Eltz, et. al., U.S. Pat. No. 5,542,972 describes the use of an aqueous formulation including a reactive dye whose reactive group contains a cyanamido group and an alkaline agent. The inks are used to print onto paper as a final substrate.

Melt transfer printing has been used since the nineteenth century to transfer embroidery designs to fabric. A design is printed on paper using a waxy ink, then transferred with heat and pressure to a final substrate. The Star process, developed by Star Stampa Artistici di Milano, uses a paper that is coated with waxes and dispersing agents. The design is printed onto the coated paper by gravure printing using an oil and wax based ink. The print is then transferred to fabric by pressing the composite between heated calendar rollers at high pressure. The ink melts onto the final substrate carrying the coloring materials with it. Fabrics printed in such a method using direct dyes are then nip-padded with a salt solution and steamed. Vat dyes can also be used in the ink, but the fabric must be impregnated with sodium hydroxide and hydros solution and steamed. The residual waxes from the transfer ink are removed during washing of the fabric. Thermal wax transfer printing utilizes a transfer ribbon consisting of a hot-melt ink coated onto a film such as PET, or Mylar. The imaging process consists of passing the ribbon past the thermal heads of a printer to cause the hot-melt ink to transfer from the ribbon to a receiver sheet. Typically, the colorants used are pigments and the receiver sheet is plain paper or a transparency. Another form of thermal transfer printing known as dye diffusion thermal transfer, or D2T2, is similar to thermal wax transfer printing. In D2T2 the colorants are dyes of the disperse or solvent type rather than pigments, and the receiver sheet is usually white plastic. Niwa, et. al., G.B. Patent No. 2,159,971A makes use of reactive disperse sublimation dyes for D2T2 printing. The dye, once transferred, forms a covalent bond with a modified receiver sheet, containing free hydroxy or amino groups. The dye, thus anchored to the receiver sheet gives good fastness properties to solvents and heat.

SUMMARY OF THE INVENTION

This invention is a formulation and method of printing an ink or meltable ink layer which comprises reactive dyes or mixtures of reactive dyes and disperse dyes as colorants. The ink or ink melt layer also includes an alkaline substance, an optional heat-activated printing additive, such as urea, and a binder material, such as wax. Permanently bonded color images are provided by the reaction between the reactive dye and the final substrate, which may be any cellulosic, protein, or polyamide fiber material, or mixtures with polyester, but not until heat activation of the printed ink image.

A digital printer prints an image onto an intermediate medium, which may be paper, at a relatively low temperature, so that the ink is not activated during the process of printing onto the medium. The image formed by the printed ink is transferred from the intermediate medium to a final substrate on which the image is to permanently appear, such as by the application of heat and pressure which activates the ink. The process produces an image on the final substrate which is water-fast and color-fast.

To prevent premature or undesired reaction, the reactive dye is protected by the wax or wax-like binder material. The protecting properties of the wax material are removed by the application of energy or heat at a temperature which is above the temperature at which printing onto the intermediate medium occurs, and which is above the melting point of the wax. This higher temperature is presented during the transfer step, or the activation step, of the process, activating the ink which has been printed in an image onto the final substrate. The colorant is thereby permanently covalently bonded to the final substrate in the form of the desired printed image.

Alternatively, a digital printer prints an image onto a substrate, followed by application of sufficient heat and pressure which activates, or fixes the ink and permanently bonds the image to the final substrate.

DESCRIPTION OF THE PREFERRED EMBODIMENTS

Figure 1:
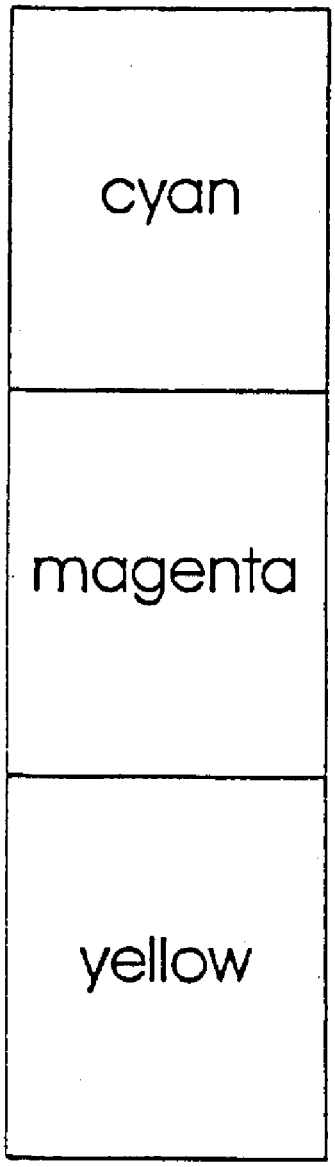
FIG. 1 demonstrates a ribbon embodiment of the invention with alternate panels of cyan, magenta and yellow.
Figure 2:
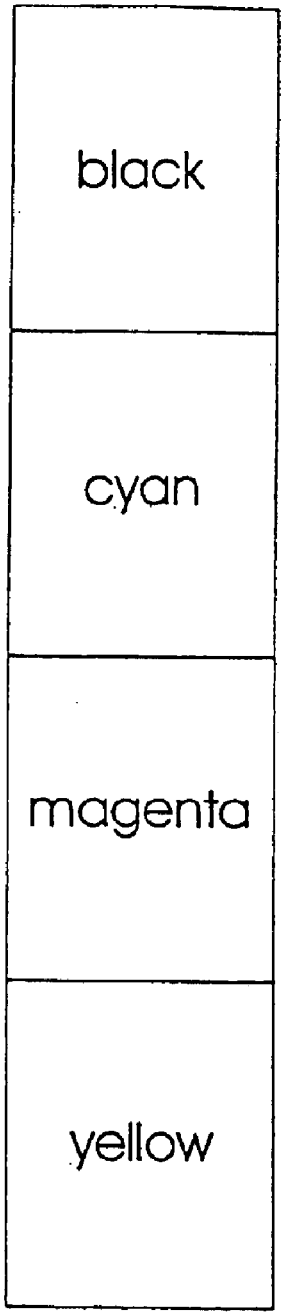
FIG. 2 demonstrates a ribbon embodiment of the invention with alternate panels of black, cyan, magenta and yellow.

In a preferred embodiment of the present invention, a heat-melt ink ribbon is formed composed of at least one colored ink panel. A repeating sequence of colored ink panels may be used. A typical pattern of panels is yellow, magenta, and cyan (FIG. 1), although black, white, or other panels could be interposed (FIG. 2). Colorants used for such ink panels are reactive dyes, which have an affinity for the final substrate, which may be for example, cellulosic fiber, such as cotton, linen, or viscose; polyamide fiber, such as nylon 6.6; mixtures of cellulose or polyamide with polyester; or protein fibers, such as wool and silk. The colorant(s) bonds permanently to the final substrate by forming a covalent bond between a carbon or phosphorous atom of the dye ion or molecule and an oxygen, sulfur, or nitrogen atom of a hydroxy, a mercapto, or amino group, respectively, of the final substrate.

In an additional embodiment of the invention, a combination of reactive and disperse dyes are used as colorants for providing an image to a cellulose, polyamide, or protein blend with polyester.

According to one embodiment of the invention, a computer designed image is first digitally melt-transfer printed from at least one ink layer onto an intermediate medium, which may be paper. The thermal printing process operates at a temperature sufficient to thermally print the multiple color ink layers, but the temperature is not sufficient to activate bonding of the ink layers between the ink layer and the intermediate medium. A higher temperature is applied, preferably with pressure, during the fixing or activation step to the back, or non-printed, side of the intermediate medium, and to the final substrate, which is in contact with the printed image, to activate and permanently bond the ink layer. The heat activates the image, bonding the ink layer to the final substrate during this fixing step in the mirror image of the original image. In this manner, the image becomes permanently bonded to the substrate and excellent durability can be achieved for the final designed image. Appropriate pressure is applied during the transfer process to ensure proper surface contact of the intermediate medium and the final substrate.

Another embodiment to the invention, the computer designed image is digitally melt-transfer printed from at least one ink layer onto the final substrate. The image is subsequently heat activated, or fixed by the application of pressure and/or heat, with or without steam to permanently bond the image to the substrate.

Figure 3:
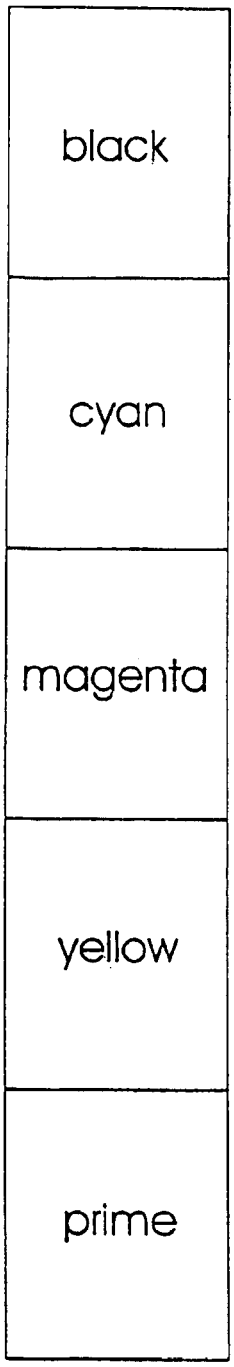
FIG. 3 demonstrates a ribbon embodiment of the invention with alternate panels of black, cyan, magenta and yellow, and a panel with a prime material forming a release layer.
Figure 4:
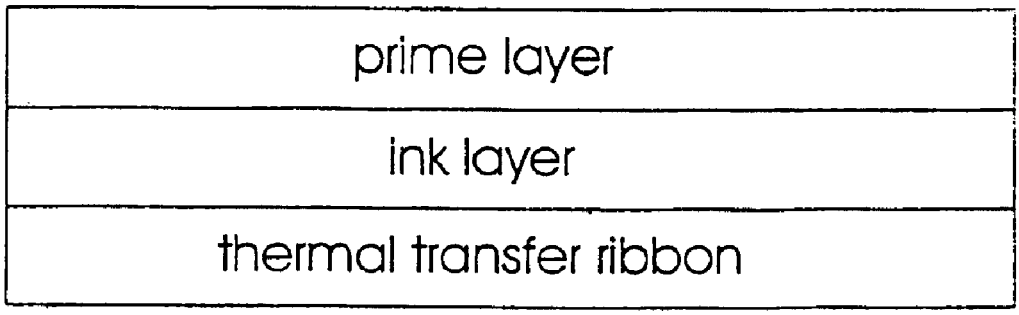
FIG. 4 demonstrates a ribbon embodiment of the invention wherein the prime material is incorporated into a panel which comprises the reactive dye.

In an alternate embodiment of the invention, an optional additional panel of clear prime material is inserted on the ribbon ahead of the color panel sequence and forms a release layer (FIG. 3). Alternatively, the optional panel of clear prime material may be on a separate ribbon from the colored ink ribbon. The printer first prints the prime layer in the shape of the image onto the intermediate medium. The printer then prints the image in the desired colors onto the intermediate medium, so that the entire image is printed onto the prime material. The image is then transferred from the intermediate medium to the final substrate by the application of heat and pressure on the back, non-printed side of the intermediate medium. This release layer primes the surface of the intermediate medium, preventing permanent bonding between the ink layer and the intermediate medium, and minimizes the requirements of the printing medium. A better release of the image from the intermediate medium is therefore achieved. The prime material may alternatively be applied as a top coat layer over each of the colored ink panels, so that a separate prime panel is unnecessary (FIG. 4).

To further enhance the permanent binding of the ink layer onto the final substrate, an additional optional separate panel of binding material may also be inserted in the color panel sequence, either ahead of or behind the ink colorant panels. The binding material may be a layer of colorless heat activated material. The binding material may include polymeric material, such as a thermoplastic resin or a crosslinkable polymer system, such as an isocyanate/polyol mixture. The printer prints the binding material in the shape of the image, or slightly beyond the image boundary, either directly onto the intermediate medium, or onto the printed ink image. The ink-binder image is then transferred from the intermediate medium to the final substrate by the application of heat and pressure, providing enhanced binding of colorant to substrate.

Bonding of the color images of the present invention is provided by the reaction between the reactive dye and the final substrate when the final substrate is a cellulosic, protein, or polyamide fiber. A reactive dye is defined as a colorant that is capable of forming a covalent bond between a carbon or phosphorous atom of the dye ion or molecule and an oxygen, sulfur, or nitrogen atom of a hydroxy, mercapto, or amino group, respectively, of the final substrate. The reactive dye can form a chemical bond with the hydroxy group in cellulose fibers, such as cotton, linen, viscose, and Lyocell; with the mercapto or amino groups in the polypeptide chains of protein fibers, such as wool and silk; or with the amino groups in polyamide fibers, such as nylon 6.6 and nylon 6.

The reactive dye may contain a water-solubilizing group, such as sulfonic acid or carboxylic acid. Examples of reactive dyes include, but are not limited to, those that contain one or more of the following functional groups: monohalogentriazine, dihalogentriazine, 4,5-dichloropyridazone, 1,4-dichlorophthalazine, 2,4,5-trihalogenpyrimidine, 2,3-dichloroquinoxaline, 3.6-dichloropyridazone, sulfuric acid ester of β-hydroxyethylsulfone, N-substituted β-aminoethylsulfone, epoxy group and precursor 2-chloro-1-hydroxyethyl, sulfuric acid ester of β-hydroxypropionamide, α,β-dibromopropionamide, phosphonic acid and phosphoric acid ester. Specific examples are, for example, those under the trade names Procion H, Procion MX, Primazin P, Reatex, Cibacron T, Levafix E, Solidazol, Remazol, Hostalan, Procinyl, Primazin, Lanasol, Procion T, respectively. Preferred are those containing the monohalogentriazine group.

Included in the class of reactive dyes are reactive disperse dyes. These dyes also react with the hydroxy group on cellulose or the amino group of polyamides to form a covalent bond. Reactive disperse dyes, however, do not contain solubilizing groups and are therefore insoluble, or sparingly soluble in water or other solvents. The reactive disperse dyes are typically sublimable.

When the final substrate is a blend of cellulosic, protein, or polyamide fiber with polyester fiber a combination of reactive and disperse dyes may be used. Disperse dyes are relatively low in molecular weight and contain minimal active functional groups. Such dyes are substantially insoluble in water or organic solvents. Examples of disperse dyes include, but are not limited to, those of the following classes: azo, anthraquinone, coumarin, and quinoline. Premixed reactive/disperse dye combinations are also commercially available. Examples are Drimafon R, Procilene, Remaron Printing Dyes, and Teracron.

In addition to the above listed colorants, the ink will contain an alkaline substance. Examples of alkaline substances used in the present invention include alkali metal hydroxides, such as potassium hydroxide and sodium hydroxide; alkali metal carbonates and bicarbonates, such as sodium carbonate and sodium bicarbonate; amines, such as mono-, di-, and triethanolamines; compounds which form alkaline substances upon application of steam, such as sodium trichloroacetate. Preferred alkaline substances are sodium carbonate and sodium bicarbonate. Also preferred is the use of sodium triacetate, which decomposes to give sodium carbonate upon application of steam and therefore a neutral printing ink may be used.

For the purpose of this invention, the term "heat-activated printing additive" will be used to describe a material which acts as a solvent for the dyes under the conditions of the transfer, or heat activation process. The heat activated printing additive therefore provides the solvent required for the dye-fiber reaction to occur. The heat-activated printing additive thus aids in the fixation of the dye to the fiber material. Typical heat transfer temperatures are in the range 175–215° C. The heat-activated printing additive will preferably be a solid at ambient temperature and have a melting point, preferably in the range 70–210° C. and lower than the transfer, or heat activation temperature, and may be contained in the ink. Examples of such heat-activated printing additives include, but are not limited to, substituted and unsubstituted ureas and thioureas, such as urea, 1,1-dimethylurea, 1,3-dimethylurea, ethylurea, and thiourea; imines, such as polyethylene imines; amides, such as anthranilamide; imides, such as N-hydroxysuccinimide; substituted or unsubstituted 5- to 7-membered saturated or unsaturated heterocyclic ring structures that possess at least one of the atoms or groups O, S, N, NH, CO, CH═, or $CH_2$ as ring members, such as caprolactam, imidazole, 2-methylimidazole, isonicotimamide, and 5,5-dimethylhydantoin, resorcinol, 2-methylresorcinol, and succinic anhydride. The heat-activated printing additive is added to the ink formulation in an amount of 0–50%, preferably 2–25%.

The ink layer will also contain binder material to the final substrate during heat transfer. The binder will also function to protect the reactive dye from direct contact with the intermediate substrate in the case where the image is first printed onto an intermediate substrate, followed by heat transfer to a final substrate. In addition, the binder functions to protect the reactive dye from contact with moisture, which would adversely effect the inks durability either on the thermal transfer ribbon or on an intermediate substrate. A binder is included in the ink to help form a smooth, flexible, and durable layer on the thermal transfer ribbon. It will also aid in the release of the ink from the ribbon panel during printing of an image, and will aid in the release of the image from the intermediate medium to the final substrate during heat transfer. The binder may be composed of a wax or wax-like material and/or a polymeric material. Examples of waxes are vegetable waxes, such as candelilla wax, carnauba wax, and Japan wax; animal waxes, such as lanolin and beeswax; crystalline waxes, such as paraffin and microcrystalline wax; and mineral waxes, such as montan and cerasin wax. Examples of wax-like materials are polyethylene oxides. Polymeric binder materials are generally non-crystalline solid materials or liquids of relatively high molecular weight which adhere the colorant to the thermal transfer ribbon during coating. Examples of suitable polymeric binder materials are rosin and modified rosins, maleic resins and esters, shellac, phenolic resins, alkyd resins, polystyrene resins and copolymers thereof, terpene resins, alkylated melamine formaldehyde resins, alkylated urea formaldehyde resins, polyamide resins, vinyl resins and copolymers thereof, acrylic resins, polyester resins, cellulosic resins, polyurethane resins, ketone resins, and epoxide resins.

The ink may contain a heat sensitive material which exotherms upon application of sufficient heat. As heat is externally supplied to the intermediate transfer medium during transfer of the printed image from the intermediate medium to the final substrate, additional heat is generated by the exothermic reaction. This additional heat lowers the amount of externally applied energy which is necessary to transfer the dye from the intermediate transfer medium to the final substrate, and/or reduces transfer time. Examples of such exothermic materials are aromatic azido compounds, such as 4,4'-bis(or di)azido-diphenylsulfone, which will undergo thermal decomposition, with the loss of molecular nitrogen as the only volatile component, forming an electron-deficient species and rapid energy dissipation and stabilization. Other examples are aromatic azido compounds carrying a water-solubilizing group, such as a sulfonic acid or carboxylic acid group. These exothermic materials typically show an exotherm in the temperature range of 175–215° C., and are thus sufficient to initiate this exotherm. The printing of the ink from the thermal transfer ribbon to the intermediate media takes place at a significantly lower temperature and therefore does not provide enough heat to activate this exothermic reaction. The exothermic materials are generally added in an amount between 1 and 20% based on the total weight of the ink.

A thermally expandable ink layer may be produced which comprises a foaming agent, or blowing agent, such as azodicarbonamide. Appropriate foaming agents include those which decompose upon heating to release gaseous products which cause the ink layer to expand. A thermally expandable ink layer may be produced which comprises volatile hydrocarbons encapsulated in a microsphere which bursts upon the application of heat. The gaseous products produced upon bursting expand the ink layer. Expanding of the ink layer gives a three dimensional structure to the image which is permanently bound to the substrate. The height of the image is dependent on the force of the pressure which is applied during heat transfer printing. These additives are preferred to be incorporated into a white-colored ink panel and especially useful when heat transferred to a dark substrate. The color image so produced is vibrant and visible on the dark fabric. These additives may be incorporated into a release, or prime layer to assist in the release of the image from the paper.

Foaming agents that evolve gas as a result of thermal decomposition are preferably used as the foaming agent. Examples of foaming agents of this type are organic expanding agents such as azo compounds, including azobisisobutyronitrile, azodicarbonamide, and diazoaminobenzene; nitroso compounds, such as N,N'-dinitrosopentamethylenetetramine, N,N'-dinitroso-N,N'-dimethylterephthalamide; sulfonyl hydrazides, such as benzenesulfonyl hydrazide, p-toluenesulfonyl hydrazide, p-toluenesulfonyl azide, hydrazolcarbonamide, and acetone-p-sufonyl hydrazone; and inorganic expanding agents, such as sodium bicarbonate, ammonium carbonate, and ammonium bicarbonate.

Thermally expandable microcapsules are composed of a hydrocarbon, which is volatile at low temperatures, positioned within a wall of thermoplastic resin. Examples of hydrocarbons suitable for practicing the present invention are methyl chloride, methyl bromide, trichloroethane, dichloroethane, n-butane, n-heptane, n-propane, n-hexane, n-pentane, isobutane, isophetane, neopentane, petroleum ether, and aliphatic hydrocarbons containing fluorine, such as Freon, or a mixture thereof.

Examples of the materials which are suitable for forming the wall of the thermally expandable microcapsule include polymers of vinylidene chloride, acrylonitrile, styrene, polycarbonate, methyl methacrylate, ethyl acrylate, and vinyl acetate, copolymers of these monomers, and mixtures of the polymers of the copolymers. A crosslinking agent may be used as appropriate.

The diameter of the thermally expandable microcapsule is in the range of 0.1–300 microns, and preferably within a range of 0.5–20 microns. A clear prime material may optionally be used to assist in the release of the printed image from the intermediate media to the final substrate. This material may be coated on the ribbon as a separate panel or coated onto the colored ink panel or panels as a top coat. The prime material may consist of uncolored heat-activated ink. For example, the prime material may consist of a layer of binder containing wax, a wax-like substance, and/or a polymeric material. Another example of a prime layer consists of a binder and a foaming agent.

All of the materials for the ink panels may be applied to the thermal transfer ribbon by any of the known methods in the art, such as by a gravure process, in a water or other solvent based system, or as a hot-melt formulation. Typical film thickness is 1–30 microns, preferably 2–10 microns.

A process of color management is preferred to be applied during the reproduction of the output when using a digital printer, so that the apparent color of a digital image on any of the final substrates will match the color of the original image as it was created. The color management process defines a method of converting the color values of a digital image from an input color space ($CS_i$) to the corresponding color values of a substrate color space ($CS_s$) while maintaining the visual color components. This process is unique for each combination of printer, final substrate, ink set, fixing/transfer device, and/or paper (or intermediate medium).

Figure 5:
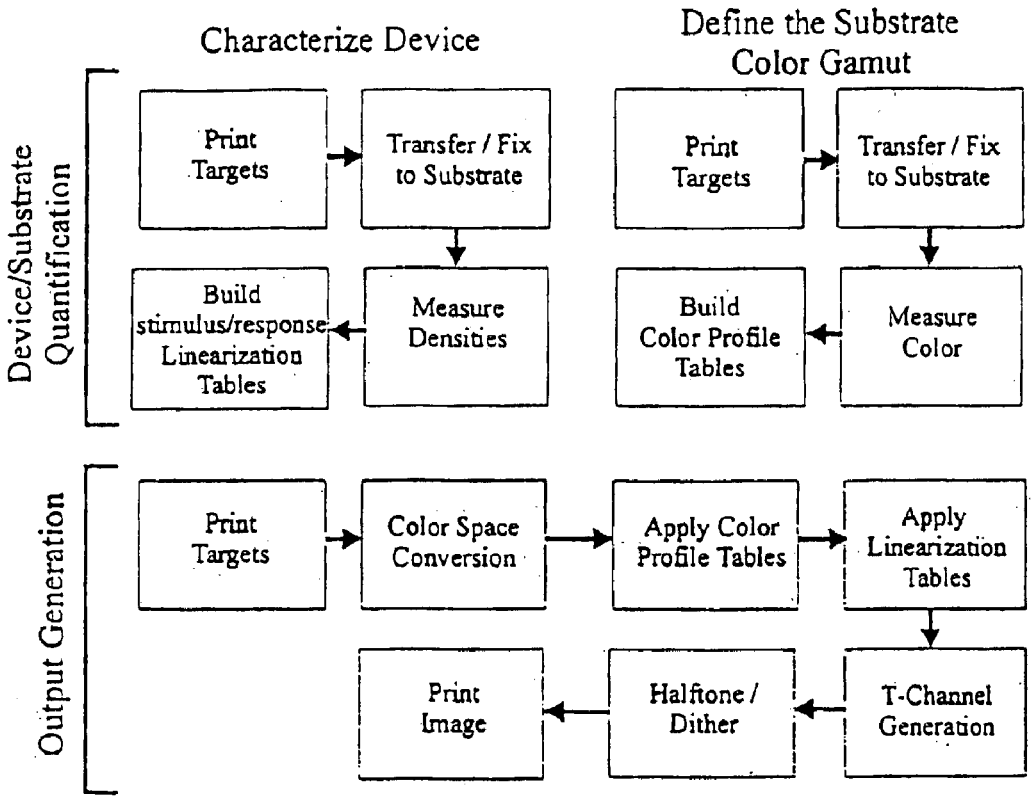
FIG. 5 is a flow chart demonstrating color management as applied to the printing process.

Color correction and color management may be accomplished by the process shown in FIG. 5, as applied to the printing process of the invention. This process is further described below.

1. Characterize the Output Device

Device characterization ensures that the density of the image on the target substrate matches the density requested by the print application. If the print application requests a 22% density square of black, a properly characterized device will produce output that will transfer to a black square of 22% density to the target substrate. If the device is not properly characterized, the final substrate will not accurately reproduce the target colors. For printed output, device characterization is accomplished by measuring the density of the printed output against a known target value. For the transfer process, device characterization must be extended to include the combination of device, ink set, release layer, and final substrate.

To characterize a device, ink, release layer and substrate combination, a table of input (stimulus) and adjustment (response) data pairs is built. This table represents the channel output values that need to be sent to the printer in order to reproduce the density on the output substrate that matches the density of the input value.

The substrate characterization process includes the combination of devices and materials associated with transfer or fixing of the image onto various final substrates. Considerations of parameters being used by these devices can also be critical to the quality of the image reproduction. Only the characterization of each combination of digital input/output devices, transfer/fixing devices, transfer mediums, and final substrates can ensure the required quality of the final product. Temperature, pressure, time, medium type, moisture level, second degree dot size change and color degradation, interrelation between inks with the media and final substrate, etc. are examples of such parameters.

The characterization table is built by sending a set of data points (stimuli), to each color channel of the printing device. The data points represent a gradation of percentage values to be printed on each of the print device's color channels (from 0 to 100%). To make this process accurately reflect the final output, considerations must be given to potential application of release layer and transfer or fixation process to a final substrate before the response measurements are taken. Using a densitometer, the densities of each color channel on the transferred output are read from the substrate. The maximum density is recorded, and a linear density scale is computed using the same percentage increments as the stimuli gradation scale. The corresponding densities from each scale are compared. For each step of the gradation, a response value is calculated. The response value is the percentage adjustment, negative or positive, that the stimulus value will be adjusted by so the target output density will match the stimulus density. These stimulus/response data points are entered into the characterization table.

The stimulus/response tables are built through repeated iterations of creating the target density squares on the substrate, measuring the density, and adjusting the associated response value. A stimulus response table must be built for each color channel of the output device.

2. Define the Substrate Color Gamut

The process of creating digital output on a printing device and transfer/fixing the output onto a final substrate can reproduce only a finite number of colors. The total range of colors that can be reproduced on any final substrate is defined as the substrate color gamut. The substrate color gamut will vary for every combination of output device, transfer temperature, transfer pressure, transfer time, transfer medium type, substrate moisture level, and final substrate. The process of defining the total range of colors that can be reproduced on an output substrate is called substrate profiling.

Profiling a non-transferred color gamut is accomplished by printing a known set of colors to a print media, measuring the color properties of the output, and building a set of stimulus/response data points. To accurately define the substrate color gamut substrate profiling must be performed after the digital image is output to the transfer media and transferred/fixed onto a substrate.

To quantify the substrate gamut, a computer application capable of creating colors using a device independent color space (typically the CIE XYZ or L*a*b color spaces) is used to generate a representative set of color squares. These color squares are modified by adjusting the density values of each color channel according the data in the characterization table, output to the printing device, and transferred/fixed to the target substrate.

A color target consisting of a set of CIE based color squares is used to measure the output gamut. The color target is converted into the print device's color space (i.e. RGB into CMYK), each channel has the percent values adjusted by the response value stored in the characterization table, sent to the output device, and transferred/fixed to the target substrate. The colorimetric properties of the color squares are measured using a colorimeter and stored as a set of stimulus/response data pairs in a color profile table. This table is the data source used by software algorithms that will adjust the requested color of a digital image so that the image, when viewed on the target substrate, has the same colorimetric properties as the original image.

A color profile table is created for each combination of output device, transfer/fixation temperature, transfer/fixation pressure, transfer/fixation time, transfer medium type, and final substrate that will be used to transfer/fix the digital image onto the final substrate.

3. Rasterization and Output of the Digital Image

If the original digital image is not in the same color space as the output device, for example an RGB image is output to a CMY device, the image is converted into the color space required by the output device. If the output device requires a black color channel, the K component (black) is computed by substituting equal amounts of the CMY with a percentage of the black color channel.

For each pixel in the image, the color value is modified. The new value is equal to the response value stored in the color profile table when the pixel's original color value is used as a stimulus. The percentage values of each of the pixel's color channels are adjusted by the amount returned from the characterization table when the pixel's color modified percentage value is used a stimulus.

A transfer process may require an additional color channel, T (transfer), for application of the transfer layer. The T channel is computed by reading the color value for each pixel location for each of the gamut-corrected color channels, C, M, Y, and K. If there is color data in any of the C, M, Y, or K color channels for that pixel, the corresponding pixel of the T channel is set to 100%.

The CMYKT digital image is halftoned using methods described in "Digital Halftoning". The CMYK channels are converted into halftone screens according to standard algorithms. The T channel will always be processed as a solid super cell, the entire cell will be completely filled. This will ensure that the release layer completely covers any of the CMYK halftone dots. The data for all of the color channels are then sent to the output device.

The process of the present invention is suitable for printing cellulosic fibers, protein fibers, and polyamide fibers, and mixtures of such with polyester. The textile material can be used in any form, for example woven fabrics, felts, nonwoven fabrics, and knitted fabrics. The following are given as examples of formulations of the invention which can be used to practice the method of the invention.

EXAMPLE 1

| Colored Ink Panel | Weight Percent |
|---|---|
| Colorant | 1–20 |
| Alkaline Substance | 0.5–10 |
| Heat-activated Printing Additive | 0–30 |
| Binder: | |
| Wax and/or Wax-like Material | 5–70 |
| Polymeric Material | 0–20 |

-continued

| | |
|---|---|
| Exothermic Material | 0–20 |
| Foaming Agent | 0–2 |

| Prime Panel/Layer | Weight Percent |
|---|---|
| Alkaline Substance | 0.5–10 |
| Heat-activated Printing Additive | 0–30 |
| Binder: | |
| Wax and/or Wax-like Material | 5–80 |
| Polymeric Material | 0–20 |
| Exothermic Material | 0–20 |
| Foaming Agent | 0–2 |

EXAMPLE 2

| Colored Ink Panel | Weight Percent |
|---|---|
| Colorant | 1–20 |
| Alkaline Substance | 0.5–10 |
| Heat-activated Printing Additive | 0–30 |
| Binder: | |
| Wax and/or Wax-like Material | 5–70 |
| Polymeric Material | 0–20 |
| Exothermic Material | 0–20 |
| Foaming Agent | 0–2 |

| Prime Panel/Layer | Weight Percent |
|---|---|
| Binder: | |
| Wax and/or Wax-like Material | 10–90 |
| Polymeric Material | 0–30 |
| Exothermic Material | 0–20 |
| Foaming Agent | 0–2 |

EXAMPLE 3

| Colored Ink Panel | Weight Percent |
|---|---|
| Colorant | 10 |
| Alkaline Substance | 5 |
| Heat-activated Printing Additive | 15 |
| Binder: | |
| Wax and/or Wax-like Material | 65 |
| Polymeric Material | 3 |
| Exothermic Material | 2 |

| Prime Panel/Layer | Weight Percent |
|---|---|
| Heat-activated Printing Additive | 5 |
| Binder: | |
| Wax and/or Wax-like Material | 87 |
| Polymeric Material | 4 |
| Exothermic Material | 2 |
| Foaming Agent | 2 |

What is claimed is:

1. A method of printing using a thermal printer, comprising the steps of:

a. applying an ink layer to a ribbon substrate, wherein said ink layer comprises a reactive dye, a binder material which is thermally meltable at an operating temperature of a thermal printer, and an alkaline material which promotes the reaction of said reactive dye with a printable substrate having an active hydrogen containing functional group available for reaction with said reactive dye;

b. supplying said thermal printer with said ribbon having said ink layer applied thereto;

c. thermally printing from said ink layer by said thermal printer and forming an image on an intermediate substrate;

d. subsequently transferring said image from said intermediate substrate to said printable substrate by the application of heat to said image and fixing said image to said printable substrate by the reaction of said reactive dye with said printable substrate.

2. A method of printing using a thermal printer as described in claim 1, wherein said ink layer further comprises a heat activated printing additive which is not meltable at said operating temperature of said thermal printer, but which is meltable at a higher temperature than said operating temperature of said thermal printer, wherein, upon transferring the image, sufficient heat is applied to melt said heat activated printing additive, and said image is transported by said heat activated printing additive to said printable substrate.

3. A method of printing using a thermal printer as described in claim 2, wherein said heat activated printing additive is urea.

4. A method of printing using a thermal printer as described in claim 3, further comprising a release layer which is applied to a portion of said ribbon substrate, wherein a portion of said release layer is transferred by means of said thermal printer onto said intermediate substrate prior to printing said image onto said intermediate substrate, and wherein said portion of said release layer which is transferred onto said intermediate substrate prevents a reaction between said intermediate substrate and said reactive dye and promotes the release of the image from the intermediate substrate when the image is transferred from the intermediate substrate to the printable substrate.

5. A method of printing using a thermal printer as described in claim 1, further comprising a release layer which is applied to a portion of said ribbon substrate, wherein a portion of said release layer is transferred by means of said thermal printer onto said intermediate substrate prior to printing said image onto said intermediate substrate, and wherein said portion of said release layer which is transferred onto said intermediate substrate prevents a reaction between said intermediate substrate and said reactive dye and promotes the release of the image from the intermediate substrate when the image is transferred from the intermediate substrate to the printable substrate.

6. A method of printing using a thermal printer as described in claim 2, further comprising a release layer which is applied to a portion of said ribbon substrate, wherein a portion of said release layer is transferred by means of said thermal printer onto said intermediate substrate prior to printing said image onto said intermediate substrate, and wherein said portion of said release layer which is transferred onto said intermediate substrate prevents a reaction between said intermediate substrate and said reactive dye and promotes the release of the image from the intermediate substrate when the image is transferred from the intermediate substrate to the printable substrate.

* * * * *